US008176985B2

(12) United States Patent
Humphreys

(10) Patent No.: US 8,176,985 B2
(45) Date of Patent: May 15, 2012

(54) WELL DRILLING AND PRODUCTION USING A SURFACE BLOWOUT PREVENTER

(75) Inventor: Gavin Humphreys, Aberdeen (GB)

(73) Assignee: Stena Drilling Ltd., Aberdeen (GB)

( * ) Notice: Subject to any disclaimer, the term of this patent is extended or adjusted under 35 U.S.C. 154(b) by 0 days.

(21) Appl. No.: 12/553,208

(22) Filed: Sep. 3, 2009

(65) Prior Publication Data

US 2009/0314544 A1 Dec. 24, 2009

Related U.S. Application Data

(60) Division of application No. 11/404,143, filed on Apr. 13, 2006, now abandoned, which is a continuation-in-part of application No. 10/697,204, filed on Oct. 30, 2003, now Pat. No. 7,032,691.

(51) Int. Cl.
*E21B 7/12* (2006.01)

(52) U.S. Cl. ..... 166/358; 166/344; 166/352; 166/363; 166/367; 175/5

(58) Field of Classification Search ..... 166/358, 166/339, 340, 344, 345, 347, 351, 352, 361, 166/363, 365, 367–370, 78.1, 84.3; 175/5–10, 175/25

See application file for complete search history.

(56) References Cited

U.S. PATENT DOCUMENTS 4,091,881 A * 5/1978 Maus ..... 175/7
5,014,789 A * 5/1991 Clarke et al. ..... 166/372
5,727,640 A * 3/1998 Gleditsch ..... 175/7
5,848,656 A * 12/1998 Møksvold ..... 175/7
5,873,420 A * 2/1999 Gearhart ..... 175/25
6,273,193 B1 * 8/2001 Hermann et al. ..... 166/359
6,325,159 B1 * 12/2001 Peterman et al. ..... 175/7
6,470,975 B1 * 10/2002 Bourgoyne et al. ..... 175/57
6,536,540 B2 * 3/2003 de Boer ..... 175/70
6,607,042 B2 * 8/2003 Hoyer et al. ..... 175/38
6,668,943 B1 * 12/2003 Maus et al. ..... 175/5
6,672,390 B2 * 1/2004 Azancot ..... 166/341
6,745,857 B2 * 6/2004 Gjedebo ..... 175/69
6,802,379 B2 * 10/2004 Dawson et al. ..... 175/38
6,823,950 B2 * 11/2004 von Eberstein et al. ..... 175/5
6,843,331 B2 * 1/2005 de Boer ..... 175/70
6,904,981 B2 * 6/2005 van Riet ..... 175/66
6,966,392 B2 * 11/2005 deBoer ..... 175/70
7,021,402 B2 * 4/2006 Beato et al. ..... 175/7
7,032,691 B2 * 4/2006 Humphreys ..... 175/62
7,090,036 B2 * 8/2006 deBoer ..... 175/70
7,237,613 B2 * 7/2007 Radi et al. ..... 166/359
7,264,058 B2 * 9/2007 Fossli ..... 166/367
7,513,310 B2 * 4/2009 Fossli ..... 166/358
7,658,228 B2 * 2/2010 Moksvold ..... 166/345

* cited by examiner

*Primary Examiner* — Thomas Beach
*Assistant Examiner* — Matthew Buck
(74) *Attorney, Agent, or Firm* — Trop, Pruner & Hu, P.C.

(57) ABSTRACT

Production and drilling may be achieved by a system which uses a rotating head coupled to surface blowout preventer stack for fluid flow control. A casing connects these surface components to a subsea shutoff assembly with a pair of ram shear devices to cut off the string to the wellhead. Both the casing and an alternate line may be latched so that they may be released if necessary. The rotating head may include a rubber packer to prevent upward flow of drilling fluid and production hydrocarbons and, at the same time, provide rotation to the drill string. Managed pressure drilling or under balanced drilling may be used in some embodiments.

8 Claims, 8 Drawing Sheets

WELL DRILLING AND PRODUCTION USING A SURFACE BLOWOUT PREVENTER

CROSS-REFERENCE TO RELATED APPLICATIONS

This application is a divisional of U.S. patent application Ser. No. 11/404,143, filed on Apr. 13, 2006 now abandoned, which is a continuation-in-part of U.S. patent application Ser. No. 10/697,204, filed on Oct. 30, 2003, which issued as U.S. Pat. No. 7,032,691.

BACKGROUND

This invention relates generally to drilling of wells and production from wells.

Generally, wells are drilled in a slightly over-balanced condition where the weight of the drilling fluid used is only slightly over the pore pressure of the rocks being drilled.

Drilling mud is pumped down the drill string to a drill bit and used to lubricate and cool the drill bit and remove drilled cuttings from the hole while it is being drilled. The viscous drilling mud carries the drilled cuttings upwardly on the outside and around the drill string.

In a balanced situation, the density of the mud going downwardly to the drill bit and the mud passing upwardly from the drill bit is substantially the same. This has the benefit of reducing the likelihood of a so-called kick. In a kick situation, the downward pressure of the drilling mud column is not sufficient to balance the pore pressure in the rocks being drilled, for example of gas or other fluid, which is encountered in a formation. As a result, the well may blowout (if an effective blowout preventer (BOP) is not fitted to the well) which is an extremely dangerous condition.

In underbalanced drilling, the aim is to deliberately create the situation described above. Namely, the density or equivalent circulating density of the upwardly returning mud is below the pore pressure of the rock being drilled, causing gas, oil, or water in the rock to enter the well-bore from the rock being drilled. This may also result in is increased drilling rates but also the well to flow if the rock permeability and porosity allowed sufficient fluids to enter the well-bore.

In this drilling environment it is general practice to provide a variety of blowout preventers to control any loss of control incidents or blowouts that may occur.

A variety of techniques have been utilized for underbalanced or dual gradient drilling. Generally, they involve providing a density lowering component to the returning drilling mud. Gases, seawater, and glass beads have been injected into the returning mud flow to reduce its density.

In deep subsea applications, a number of problems may arise. Because of the pressures involved, everything becomes significantly more complicated. The pressure that bears down on the formation includes the weight of the drilling mud, whereas the pressure in the shallow formations is dictated by the weight of seawater above the formation. Because of the higher pressures involved, the drilling mud may actually be injected into the formation, fracture it and may even clog or otherwise foul the formation itself, severely impairing potential hydrocarbon production.

DETAILED DESCRIPTION

In some embodiments of the present invention, both drilling and production of fluids from a formation may occur in an underbalanced condition. As used herein, "underbalanced" means that the weight of the drilling mud is less than the pore pressure of the formation. As used herein, "dual gradient" refers to the fact that the density of fluid, at some point along its course, moving away from a drill bit, is lower than the density of the fluid moving towards the drill bit. Dual gradient techniques may be used to implement underbalanced drilling. The creation of a dual-gradient or underbalanced condition may be implemented using any known techniques, including the injection of gases, seawater, and glass beads, to mention a few examples.

Figure 1:
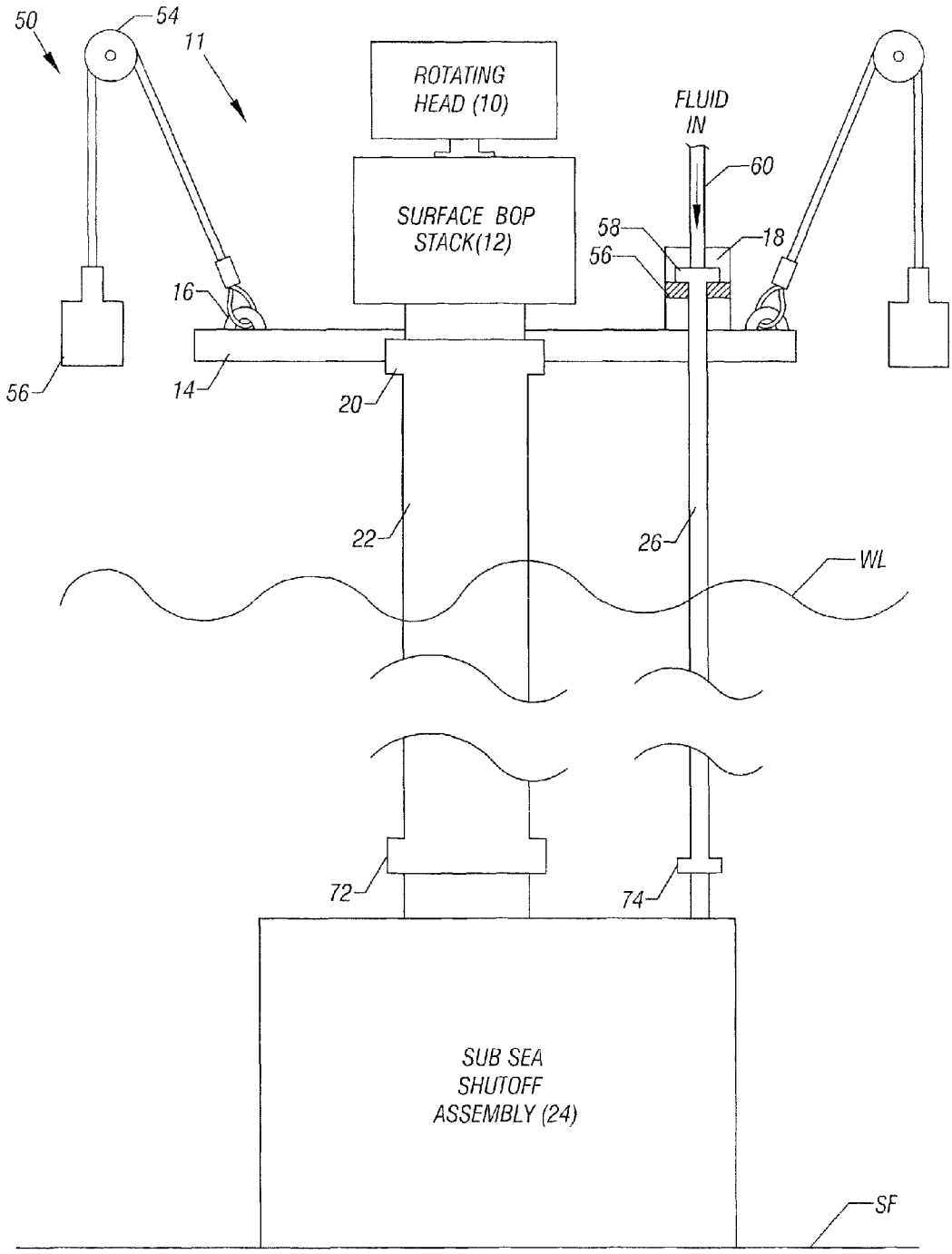
FIG. 1 is a schematic depiction of one embodiment of the present invention.
Figure 4:
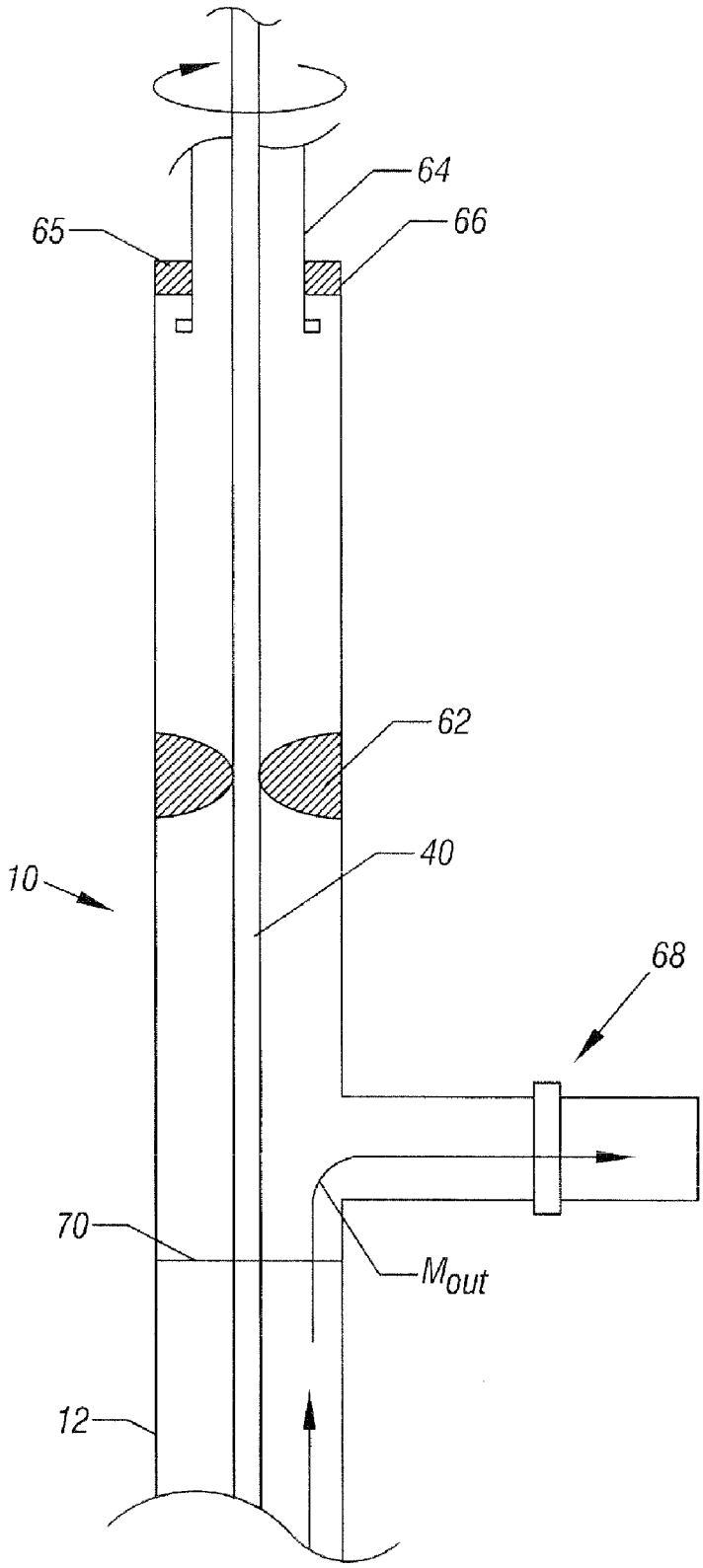
FIG. 4 is a schematic cross-sectional view of the rotating head shown in FIG. 1 in accordance with one embodiment of the present invention.

Referring to FIGS. 1 and 4, a drilling and production apparatus 11 may include a rotating head 10 which has a sealed bearing 65 and elastomer pack-off 62 that seals off around the drill string 40 while drilling operations take place. The return fluids are then diverted to a flow line below the pack-off 62 to a choke assembly 68 that controls the flow of the return fluid and hence the bottom hole pressure created by the mud column. The rotating head 10 rotates the string 40 through a surface blowout preventer (BOP) stack 12. The surface blowout preventer stack 12 may include annular blowout preventers that control the flow of fluid moving upwardly from the wellhead to the overlying apparatus 11.

The apparatus 11 may be tensioned using ring tensioners 16, coupled by a pulleys 54 to hydraulic cylinders 56 to create a tensioning system 50. The pulleys 54 may be connected to the apparatus 11, be it a rig or ship, so that the tensioners can maintain tension on the riser even when the apparatus is heaving up and down. The tensioning system 50 allows the upper portion of the apparatus 11 to move relative to the lower portion, for example in response to sea conditions. The system 50 allows this relative movement and adjustment of relative positioning while maintaining tension on the casing 22, which extends from a riser tension ring 14 downwardly to a subsea shutoff assembly 24. The tension ring 14 takes the weight of the surface blowout preventer 12 and holds the tension on the casing riser 22.

The surface portion of the apparatus 11 is coupled by a connector 20 to the casing riser 22. The casing riser 22 is connected to the lower section of the apparatus 11 via a disconnectable latch 72 located below the sea level WL. The latch 72 may be hydraulically operated from the surface to disconnect the upper portion of the apparatus 11 from the lower portion including the subsea shutoff assembly 24.

Also provided on the ring 14 is a source of fluid that is of a lower density than the density of mud pumped downwardly through the casing riser 22 from the surface in one embodiment of the present invention. The lower density fluid may be provided through the tubing 60.

A hanger system includes a tensioner 58 that rests on a support 56. The hanger system tensions the tensioned tubing 26 that extends all the way down to a disconnectable subsea latch 74 above the subsea shutoff assembly 24. Like the latch 72, the latch 74 may be remotely or surface operated to sever and seal the tubing 26 from the subsea shutoff assembly 24 prior to disconnecting the riser at latches 72 and 74. In one embodiment, the support 56 may include hydraulic ram devices that move like shear ram blowout preventers to grip the tubing 26.

The rate of lower density fluid flow through the tubing 26 from the surface may be controlled from the surface by remotely controllable valving in the subsea shutoff assembly 24, in one embodiment. It is advantageous to provide this lower density fluid from the surface as opposed to attempting to provide it from a subsea location, such as within the subsea shutoff assembly 24, because it is much easier to control and operate large pumps from the apparatus 11.

Figure 2:
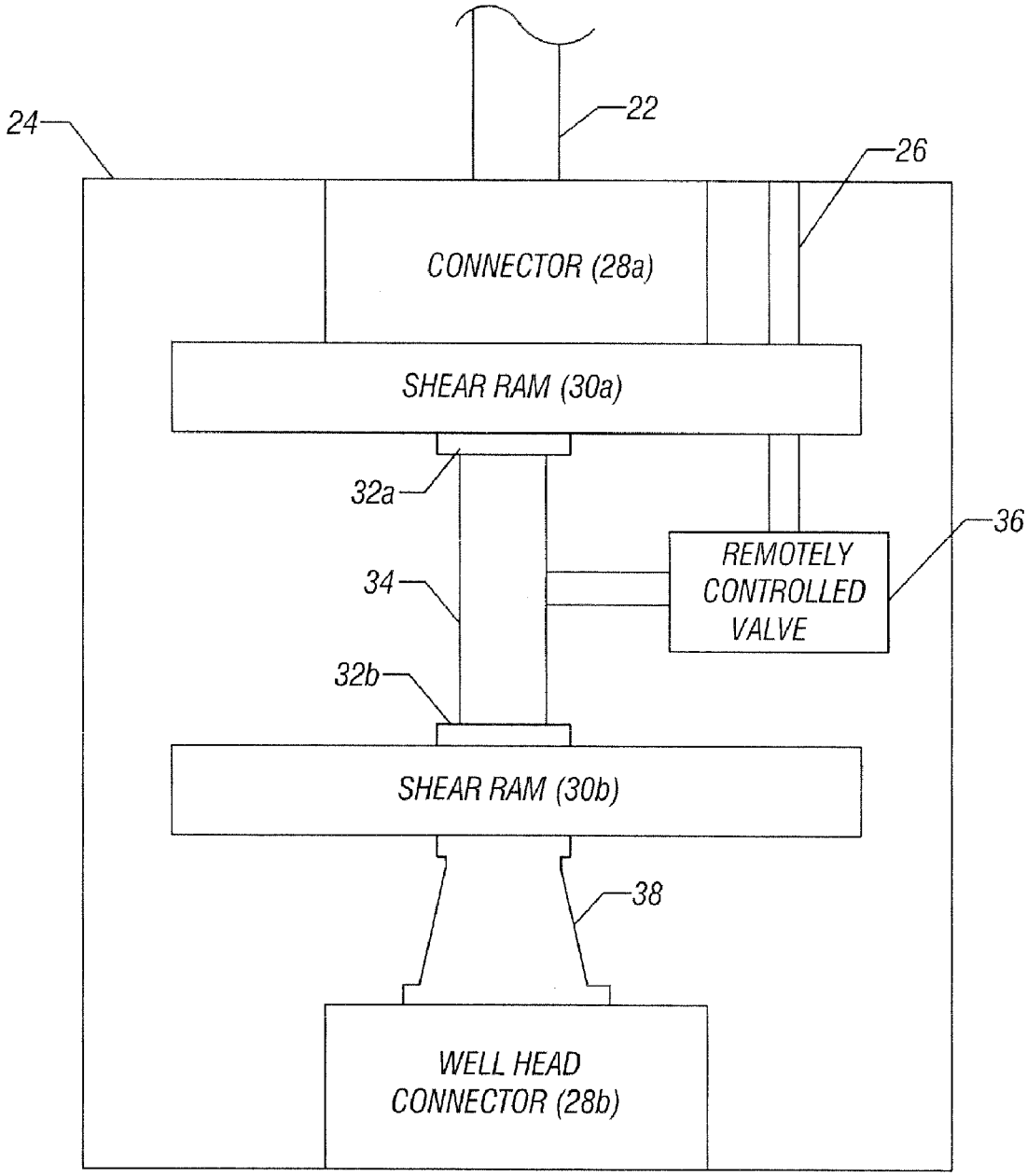
FIG. 2 is an enlarged schematic depiction of the subsea shut-off assembly shown in FIG. 1 in accordance with one embodiment of the present invention.

The subsea shutoff assembly 24 operates with the surface blowout preventer stack 12 to prevent blowouts. While the surface blowout preventer stack 12 controls fluid flow, the subsea shutoff assembly 24 is responsible for cutting off or severing the wellhead from the portions of the apparatus 11 thereabove, using shear rams 30*a* and 30*b* as shown in FIG. 2. Thus, the casing 22 may be coupled by connector 28*a* to the shear ram 30*a*. The shear ram 30*a* is coupled by a spool 34 with flanges 32*a* and 32*b* to the shear ram 30*b*. The shear ram 30*b* may be coupled through the flange 38 to a wellhead connector 28*b*, in turn connected to the wellhead.

As shown in FIG. 2, the tubing 26 connects to a remotely controlled valve 36 that controls the rate of lower density fluid flow through the tubing 26 to the interior of the spool 34. The inlet from the tubing 26 to the spool 34 is between the two shear rams 30*a* and 30*b*.

Figure 3:
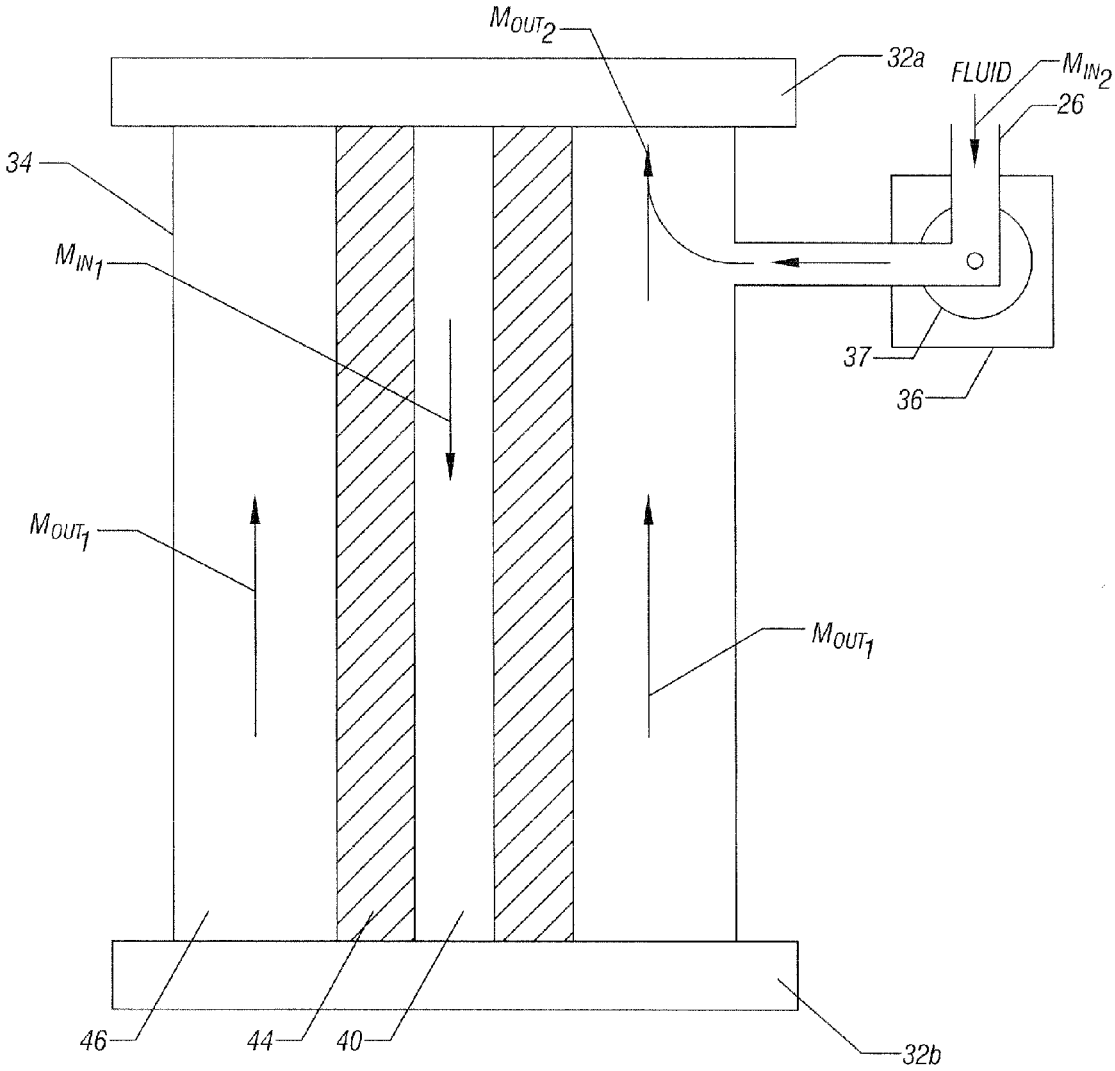
FIG. 3 is an enlarged, schematic, cross-sectional view of the spool 34 shown in FIG. 2 in accordance with one embodiment of the present invention.

The injection of lower density fluid, as shown in FIG. 3, makes use of the remotely controlled valve 36 on a spool 34. The spool 34 may have drilling mud, indicated as MIN, moving downwardly through the casing 22. The returning mud, indicated as $M_{OUT}$, extends upwardly in the annulus 46 surrounding the string 40 and annulus 44. Thus, lower density fluid may be injected, when the valve 36 is opened, into the returning mud/hydrocarbon flow to lower its density.

An underbalanced situation may be created as a result of the dual densities of mud in one embodiment. Namely, mud above the valve 36 may be at a lower density than the density of the mud below the valve 36, as well as the density of the mud moving downwardly to the formation. The valve 36 may include a rotating element 37 that allows the valve 36 to be opened or controlled. As an additional example, the valve 36 may be a pivoted gate valve with a hydraulic fail safe that automatically closes the valve in the event of a loss of hydraulics. The valve 36 may enable the extent of underbalanced drilling to be surface or remotely controlled depending on sensed conditions, including the upward pressure supplied by the formation. For example, the valve 36 may be controlled acoustically from the surface.

Thus, in some embodiments of the present invention, flow control may be done most effectively at the surface, whereas shutoff control is done on the seafloor bed. The pumping of the lower density fluid is also done on the surface, but its injection may be done at the subsea shutoff assembly 24, in one embodiment between the shear rams 30*a* and 30*b*.

The rotating head 10, shown in more detail in FIG. 4, is coupled to the surface blowout preventer stack 12 at a joint 70. Returning fluid, indicated as $M_{OUT}$, is passed through a valve 68 to an appropriate collection area. The collection area may collect both mud with entrained debris, as well as production fluids such as hydrocarbons. The production fluids may be separated using well known techniques.

The upward flow of the fluid $M_{OUT}$ is constrained by a pack off 62. In one embodiment, the pack off 62 is a rubber or resilient ring that seals the annulus around the string 40 and prevents the further upward flow of the fluids. At the same time, the pack off 62 enables the application of a rotating force in the direction of the circular arrow from the rotating head 66 to the string 40 for purposes of drilling. Sealed bearing 65 may be provided between a telescoping joint 64 and the rotating head 66 as both drilling and production may be accomplished in an underbalanced situation.

Thus, in some embodiments of the present invention, a subsea shutoff assembly 24 may be provided to cut off the string in the event of a failure, such as a blowout. At the same time, surface annular blowout preventers control fluid flow. Dual gradient drilling may be achieved through the provision of fluid from the surface through a side inlet into the region between the upper and lower ram type shear blowout preventers 30. Through the provision of the separate tubing 26 with a remotely operable latch 74, appropriate volumes of fluid can be achieved that would not be available with conventional kill and choke lines. The tubing 26 for providing the density control fluid may be both tensioned and latched. As a result, dual gradient production and drilling may be achieved in some embodiments of the present invention.

Figure 5:
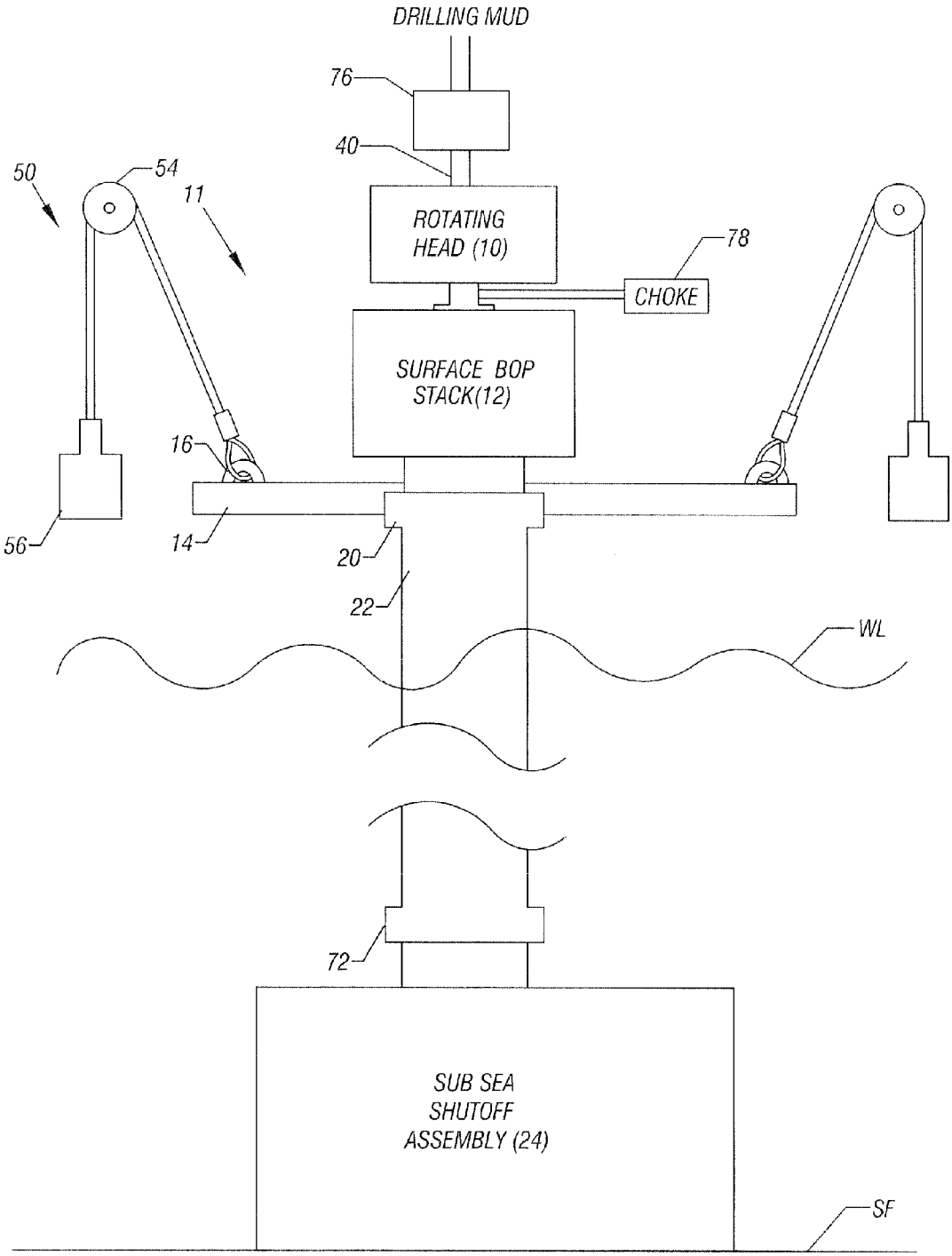
FIG. 5 is a schematic depiction of another embodiment of the present invention.

Referring to FIG. 5, in accordance with another embodiment of the present invention, lower density drilling mud may be injected at an appropriate time. Namely, instead of simply supplying the density lowering fluid on a continuous basis, at the point when production is ready to begin, lower density drilling fluid is pumped downwardly through the top device 76 and the drill string 40.

Figure 7:
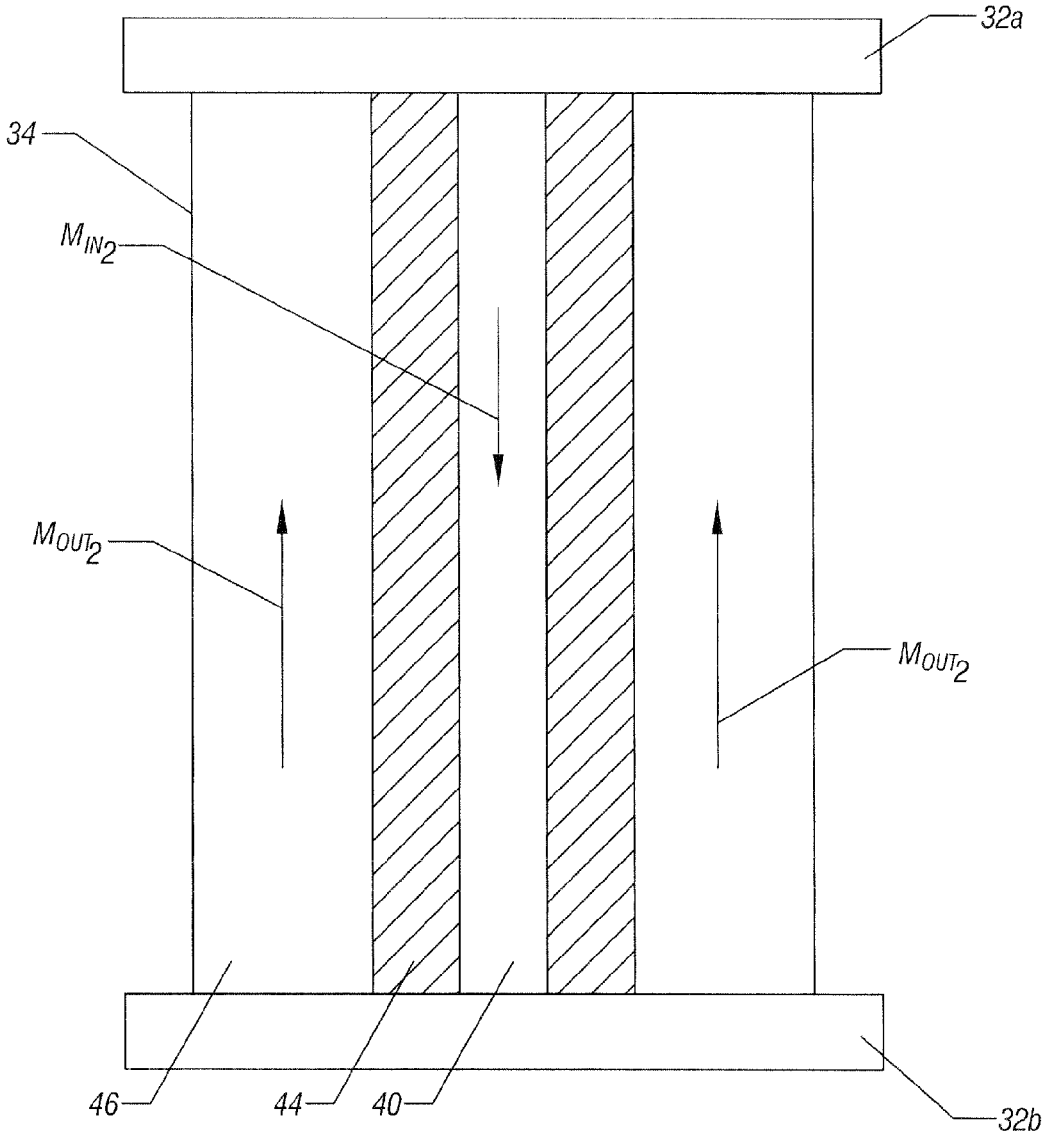
FIG. 7 is an enlarged, schematic, cross-sectional view of the spool 34 shown in FIG. 6 in accordance with one embodiment of the present invention.

A density lowering fluid lowers the density of the drilling mud moving downwardly into the drill hole towards the drill bit. The lower density drilling mud is pumped to the drill bit and then moves upwardly through the drill pipe open hole casing annulus or spool 34 (FIG. 7). The drill bit may include at least one one-way check valve.

Figure 6:
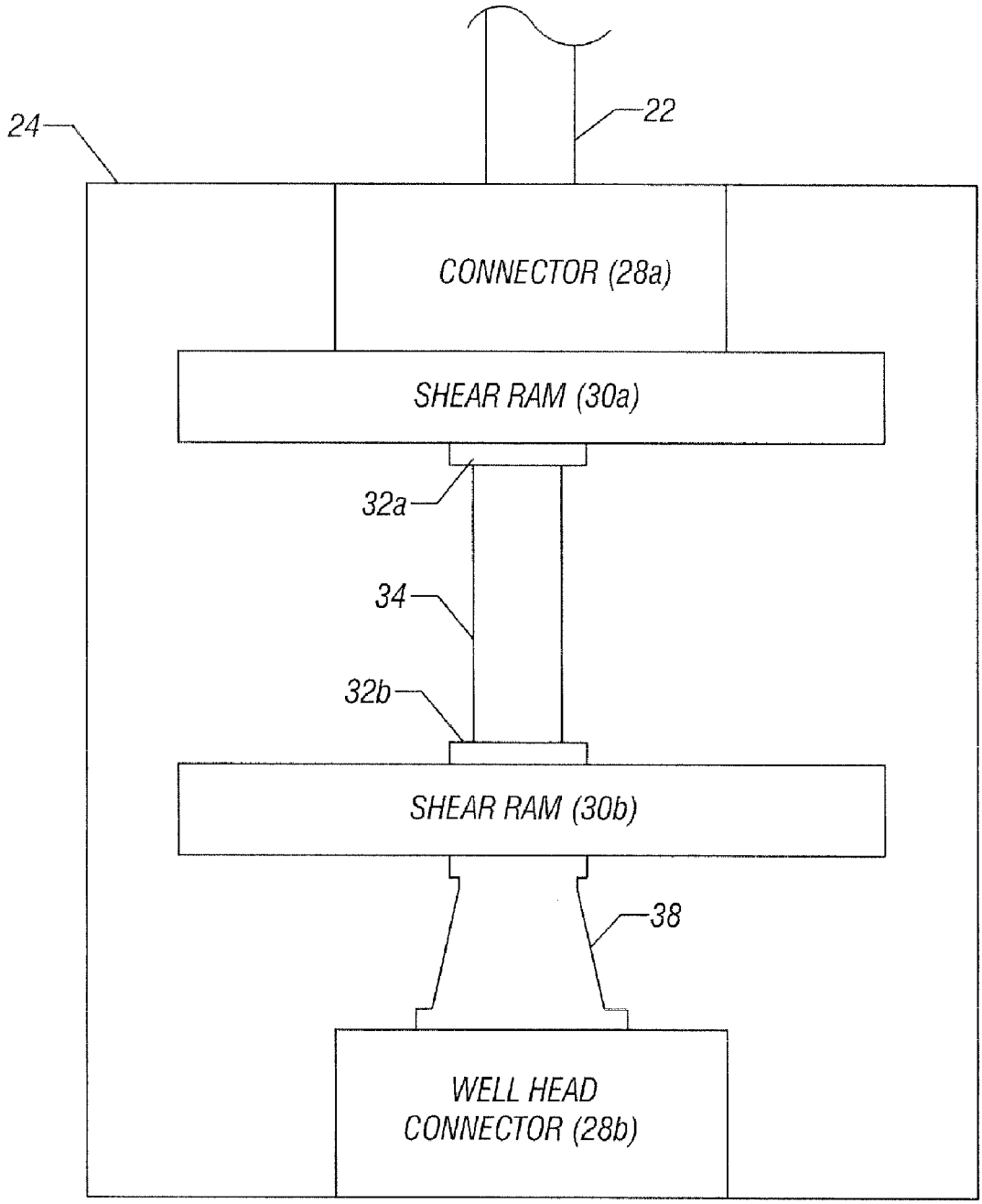
FIG. 6 is an enlarged, schematic depiction of a subsea shut-off valve shown in FIG. 5 in accordance with another embodiment of the present invention.

Thus, referring to FIGS. 5 and 6, there is no need for any down hole injection of density lowering fluid since that fluid is pumped down the drill string 40.

Similarly, referring to FIG. 7, the spool 34 need have no accommodation for the injection of density lowering fluid as in the previous embodiment. Instead, the fluid $M_{in2}$ is already of lowered density when production begins and the fluid reaches the spool 34. Thus, in some embodiments, prior to the inception of production, the well may be operating in a balanced or overbalanced condition. Upon production, the density of the drilling mud may be reduced by lower density drilling mud through the top drive.

Figure 8:
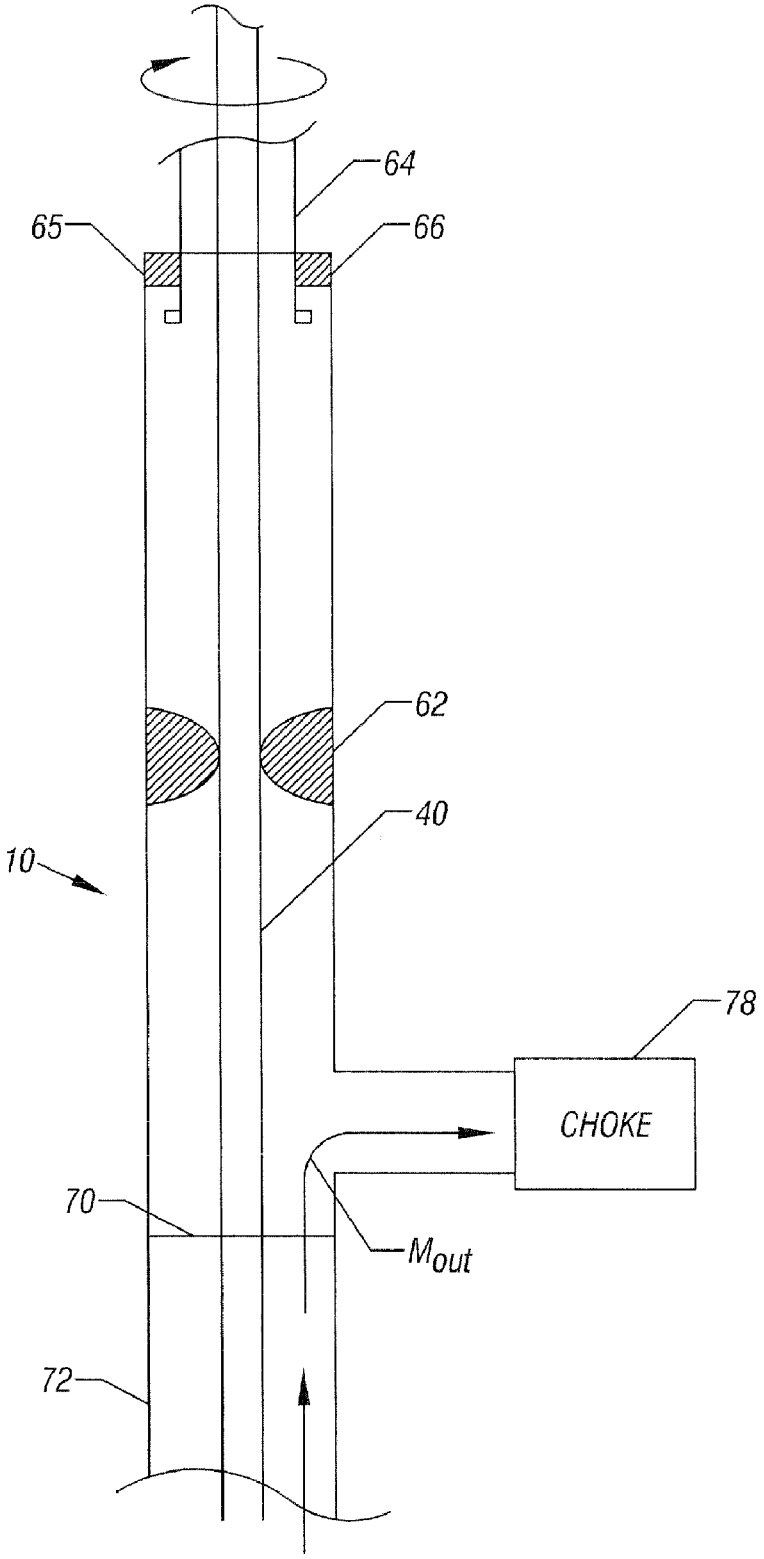
FIG. 8 is a schematic cross-sectional view of the rotating head shown in FIG. 5 in accordance with another embodiment of the present invention.

Finally, referring to FIG. 8, the upward flow of fluid, first shown in FIG. 7 and indicated as $M_{out2}$ is of reduced density for two reasons. It contains the density lowering fluid that was pumped downwardly through the drill string 40. Secondly, it includes the flowing hydrocarbons or fluids which further lower the density of the drilling mud.

Therefore, the fluid moving upwardly, indicated as $M_{out2}$ is of a density lower than the density of the downwardly moving fluid $M_{in2}$. Moreover, both $M_{in2}$ and $M_{out2}$ are of lower density than the previously pumped drilling mud which was unaccompanied by density lowering fluid added through the top drive 76.

The outward flow of drilling fluid, indicated as $M_{out}$ in FIG. 8, may pass outwardly through a choke 78. The choke 78, also shown in FIG. 5, is positioned between the rotating head 10 and the surface blowout preventer stack 12 to maintain control. The choke 78 back pressure controls the egress of the drilling mud to control well pressure and inflow from the wellbore.

In addition, in some embodiments, the drill string 40 will have two non-return valves installed above in the drill bit at the bottom of the drill string 40. These valves will reduce the probability of uncontrolled flow inside the drill string 40.

Thus, the fluid pressure in the bottom of the hole may be lower than the pore pressure of the surrounding formation. As a result, an underbalanced drilling situation is established when production begins.

In accordance with still another embodiment, managed pressure drilling (MPD) may be used instead of overbalanced or underbalanced drilling. In managed pressure drilling, the pressure of the drilling mud exactly balances the pore pressure in the formation. In such case the drilling mud pumped downwardly into the formation exactly matches the formation pore pressure.

The pressure within the spool 34 and through the drill string 40 may be managed by the choke 78 in some embodiments. By controlling the rate of egress of fluids indicated as $M_{out}$, the pressure within the spool 34 and the remainder of the string 40 may be controlled. In other words, slowing the egress of fluids increases the pressure and opening the choke decreases the pressure. In this way, the choke 78 may be utilized in conjunction with the valve 76 to control the pressure within the system. In one embodiment, the pressure may be controlled to set a drilling mud pressure which precisely balances the pore pressure, achieving managed pressure drilling.

In some embodiments, a flex joint and telescopic joint may be used to connect the surface blowout preventer stack 12 to the valve 76 in other components.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A drilling rig comprising:

a rotating head;

a drill string coupled to said rotating head and rotated by said rotating head, said drill string including a drill bit, wherein said rotating head includes a resilient packer and said drill string and tubing, said resilient packer to seal the region between said drill string and said tubing and to transfer rotational energy from said tubing to said drill string;

a surface blowout preventer mounted under said rotating head on said rig;

an apparatus to pump lower density drilling mud to the bottom of a hole through said drill string and drill bit;

a subsea shutoff assembly, said string passing through said assembly, an annulus in said assembly, returning drilling mud to move upwardly through said annulus in said assembly around said string; and a valve connected to said annulus to selectively inject density lowering fluid into said returning mud.

2. The rig of claim 1 including a connector coupled from said surface blowout preventer to the subsea shutoff assembly.

3. The rig of claim 2 wherein said subsea shutoff assembly includes a pair of shear blowout preventers.

4. The rig of claim 3 including a remotely operable latch to disconnect said connector from said subsea shutoff assembly in the event of an emergency.

5. The rig of claim 4 wherein said connector is tensioned.

6. The rig of claim 5 wherein said subsea shutoff assembly includes a pair of shear ram subsurface blowout preventers and said connector on top of said pair of shear ram subsurface blowout preventers.

7. The rig of claim 1 including a riser coupled to said surface blowout preventer.

8. The rig of claim 7 including a choke coupled to said surface blowout preventer to control the pressure in said riser.

* * * * *